US005184746A

United States Patent [19]

Moore et al.

[11] Patent Number: 5,184,746

[45] Date of Patent: Feb. 9, 1993

[54] CLOSURE CAP AND FITMENT ASSEMBLY

[75] Inventors: David N. Moore, Plainfield; Jeffrey F. Ullrich, Western Springs, both of Ill.

[73] Assignee: Phoenix Closures, Inc., Naperville, Ill.

[21] Appl. No.: 841,986

[22] Filed: Feb. 26, 1992

[51] Int. Cl.[5] ..... B65D 47/06; B65D 51/18

[52] U.S. Cl. ..... 220/256; 220/258; 220/356; 220/521; 215/227; 215/277; 215/349; 215/232; 222/562; 222/565

[58] Field of Search ..... 220/254, 255, 256, 258, 220/212, 356, 521, 744; 215/227, 228, 277, 341, 350, 349, 232; 222/545, 562, 565

[56] References Cited

U.S. PATENT DOCUMENTS

| | | | |
|---|---|---|---|
| 2,547,590 | 4/1951 | McGinnis | 215/277 X |
| 2,576,416 | 11/1951 | Randlett | 215/277 X |
| 3,125,260 | 3/1964 | Dreps | 222/565 X |
| 3,131,824 | 5/1964 | Van Baarn | 222/565 X |
| 3,209,964 | 10/1965 | Knight | 222/545 |
| 3,260,426 | 7/1966 | Ayotte | 222/545 |
| 3,276,642 | 10/1966 | Johnson, Jr. et al. . | |
| 3,325,066 | 6/1967 | Allen | 222/545 |
| 3,469,748 | 9/1969 | Meyers . | |
| 3,715,063 | 2/1973 | Susuki et al. | 222/545 |
| 3,980,211 | 9/1976 | Owens . | |
| 4,076,152 | 2/1978 | Mumford . | |
| 4,187,964 | 2/1980 | Bogart . | |
| 4,433,800 | 2/1984 | Owens . | |
| 4,437,593 | 3/1984 | Bullock, III | 222/565 X |
| 4,600,131 | 7/1986 | Roof et al. . | |
| 4,981,229 | 1/1991 | Lanham | 215/232 |
| 5,111,978 | 5/1992 | Mengeu | 222/545 |

*Primary Examiner*—Allan N. Shoap
*Assistant Examiner*—Vanessa Caretto
*Attorney, Agent, or Firm*—Welsh & Katz, Ltd.

[57] ABSTRACT

A closure cap and fitment assembly configured for use with a container having a neck with an annular lip at its uppermost end defining a mouth. The closure cap and fitment assembly includes a fitment with a dispensing surface dimensioned to span the mouth of the container and a liner. The assembly further includes a cap with a top panel, an annular skirt and threads for releasable engagement onto the neck of the container. The inner portion of the cap defines a retaining structure which is designed to retain the fitment and liner within the cap.

20 Claims, 2 Drawing Sheets

CLOSURE CAP AND FITMENT ASSEMBLY

The present invention relates to closures for containers and, more specifically, to a closure and fitment assembly for containers in which a closure fitment is stored within the closure prior to use.

BACKGROUND OF THE INVENTION

There are currently numerous types of closure assemblies which include a particular fitment for dispensing the contents of a container. Typical dispensing fitments, such as sifter fitments, are designed to snap onto or otherwise engage the mouth of the container and to remain on the container when the closure cap is removed. Such fitments are generally included as part of the container package for a variety of liquid and granular or powdered substances. In addition, most container closure assemblies provided with fitments include a liner that spans the mouth of the container to prevent tampering, leakage or spoilage of the contents of the container.

Frequently the liner, fitment and closure cap are sold, distributed and stored separately prior to assembly upon the container. The assembly of the closure to a container entails several steps. Typically, a liner is applied to the inside of the fitment, the fitment and liner are then applied to the mouth of the container and the closure cap is secured to the container. Because the fitment is applied over the liner and onto the container, the user must normally snap the fitment off, remove the protective liner and then reapply the fitment to the container before being able to dispense the product.

Thus, the handling and assembly costs of currently available closure assemblies are significantly increased when a fitment is incorporated as part of the package. Not only are the packaging costs increased by the addition of a particular fitment, but the consumer is burdened with trying to remove and subsequently reapply the fitment. Often a consumer may simply decide to remove the liner and forego the step of reapplying the fitment. Thus, there is a need for a closure assembly in which the cap and the fitment are assembled as a unit and are sold, stored and applied to the container as a unit.

SUMMARY OF THE INVENTION

It is, therefore, an object of the invention to provide a closure cap and fitment assembly in which the fitment is stored within the closure cap until the user applies the fitment to the container.

Another object of the present invention is to provide a closure cap, fitment and liner assembly which can be stored, shipped and subsequently applied to a container as a unit.

Another object of the present invention is to provide a closure cap which is designed to store a product dispensing fitment, such as a sifter, within its inner cavity and which is held therein until the user removes the fitment and secures it onto the container neck.

In accordance with the present invention, all of these objects, as well as others not herein identified, are achieved generally by the present closure cap and fitment assembly, wherein the closure cap is designed to house or store a fitment within an inner cavity until the user removes the fitment and applies it to the mouth of the container. The closure cap and fitment of the present invention are designed for simple preassembly and application to a container.

More specifically, the present invention includes a closure cap and fitment assembly configured for use with a container having a neck with an annular lip at its uppermost end defining a mouth. The fitment has a dispensing surface dimensioned to span the mouth of the container. The cap has a top panel, an annular skirt depending peripherally from the top panel and threads for releasable engagement onto the neck of the container. The cap is formed with a fitment retaining structure designed to retain the fitment within the cap prior to use.

Additionally, the present closure cap is designed to store a sealing liner which also performs a secondary retaining function for retaining the fitment within the closure cap prior to assembly of the closure, as a unit, to the container. Hence, the closure cap, fitment and liner are assembled together as a unit, and have the advantages of being economically and easily stored, transported and applied to a container.

BRIEF DESCRIPTION OF THE DRAWING

Further objects of the invention, taken together with additional features contributing thereto and advantages occurring therefrom, will be apparent from the following description of the invention when read in conjunction with the accompanying drawings, wherein:

FIG. 4-A is a partial sectional view of the liner in an alternate embodiment of the present closure and fitment assembly as shown in FIG. 2.

DETAILED DESCRIPTION OF THE INVENTION

Figure 1:
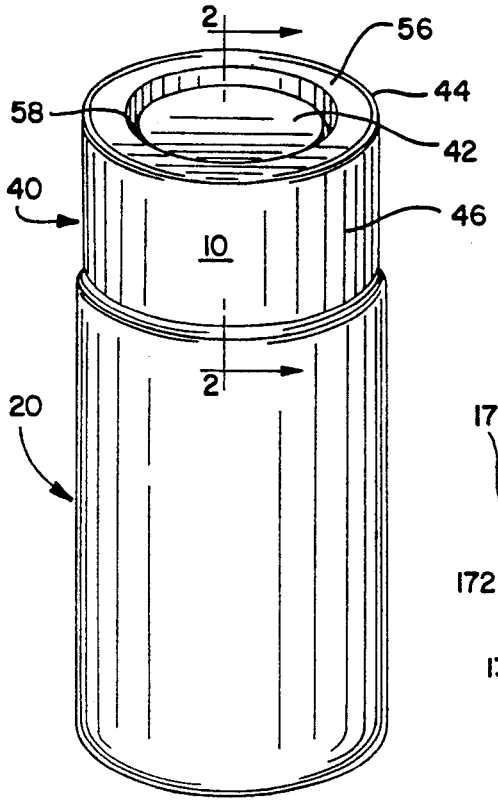
FIG. 1 is a top perspective view of the present closure and fitment assembly shown engaged upon a container.
Figure 2:
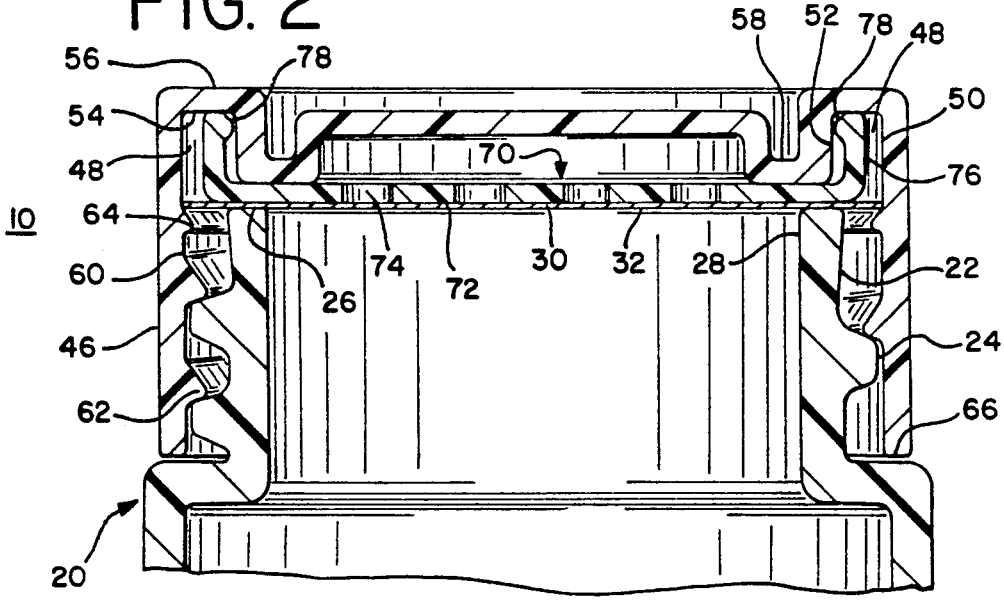
FIG. 2 is a sectional view taken along the line 2—2 of FIG. 1 and in the direction indicated generally.
Figure 3:
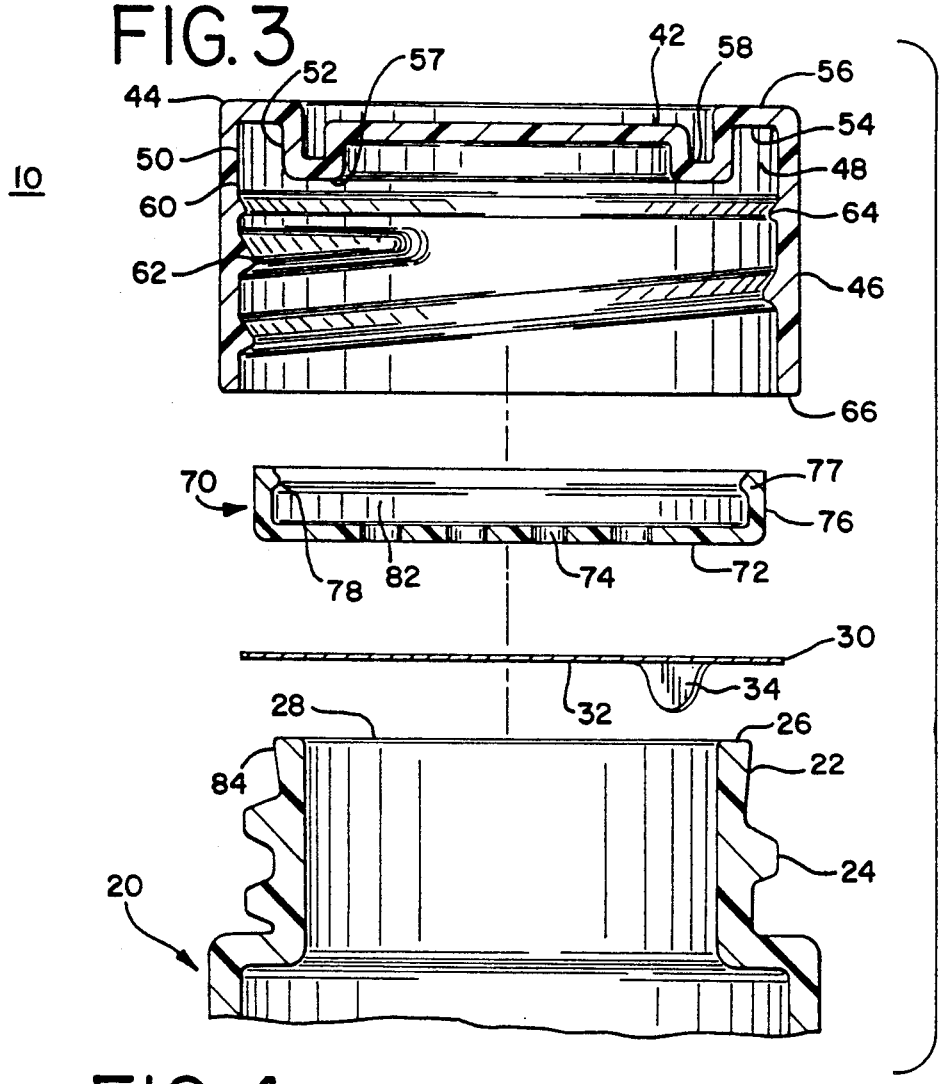
FIG. 3 is an exploded view of the present closure and fitment assembly showing the distinct elements including the container, liner, sifter and closure.

In the drawings, FIGS. 1-3, wherein a preferred embodiment of the invention is shown, and wherein similar reference characters designate corresponding parts throughout the several views, 10 generally designates the present closure, fitment and liner assembly. The closure, fitment and liner assembly 10, is typically designed for use with any type of container 20 used for storing and dispensing granular or powdered substances, liquids or other substances. Although a specific type of container is not required for assembly of the present closure 10, it is contemplated that the container 20 will include a container neck 22, which may include external threading 24 designed to engage complementary threading on the inside surface of the closure 10. The neck 22 terminates at an upper end in an annular lip 26 which defines the container mouth 28. The closure 10 essentially consists of three portions or sections; a protective liner 30, a closure cap 40, and a fitment 70.

The protective liner 30 includes a two-sided panel which when applied to the container 20 covers the mouth 28. The liner 30 prevents spillage, leakage, or spoilage of the contents of the container 20 prior to application of the fitment 70 and also performs a tamper indicating function. It is contemplated that the protective liner 30 includes a lower surface 32 incorporating an adhesive of the type known in the art for securing such liners to the mouth of a container. The liner 30 may also be secured to the annular lip 26 using other conventional methods such as heat sealing or the like. Regardless of the method of attachment used, it should be understood that the liner 30, as part of the closure 10, is intended to be applied to the container 20 along with the closure cap 40 and the fitment 70 in a single step upon assembly of the unit to a container 20. Additionally, to facilitate the removal of the liner 30 from within the closure cap 40, a pull tab 34 can be integrally formed as part of the liner 30.

It is contemplated that the closure cap 40 will be manufactured of any conventional plastic material used for molded closures, such as polypropylene. More particularly, the closure cap 40 includes a top panel 42, a peripheral edge 44, and a depending annular skirt 46 integral with the edge 44.

In the preferred embodiment, the closure cap 40 is designed to retain the fitment 70 in an inverted position beneath the top panel 42. To this end, the closure cap 40 is configured to define a fitment retaining area 48. As shown in FIGS. 1-3, the fitment retaining area 48 will generally be configured as a chamber, or more specifically, an inner annular channel defined by an outer channel wall 50, an inner channel wall 52, and an underside, or upper inner surface 54. It should also be understood that the height of the closure cap 40 is not dependant on the orientation of the fitment 70 within the closure cap 40.

If the fitment retaining area 48 is configured as a channel, it will typically be located at the outermost periphery of the inside of the closure cap 40. The formation defining the inner boundary, or inner channel wall 52, of the annular channel is preferably a ring 57. Further, the ring 57, or other structure defining the fitment retaining area 48, may be continuous or segmented.

It is contemplated that the channel can be located at any other more inward point within the closure cap 40 to accept and retain fitments 70 of different sizes. Furthermore, it is contemplated that the channel walls 50 and 52 may be angled to more securely retain the fitment 70 or to accept other varieties of fitment. Moreover, the fitment retaining area 48, although depicted as circular in shape, may be configured in other shapes, and may include beads, ledges, grooves and/or other formations as needed to retain various configurations of fitment 70. Walls 50 and 52 are shown substantially vertical in cross-section, but alternatively, may be angled to change the configuration of the chamber, or retaining area 48.

As depicted in FIGS. 1 and 2, because the particular configuration of the fitment retaining area 48 in this embodiment is a channel, the closure cap 40 takes on a distinct outer configuration which includes a peripheral ridge 56 and a groove 58. However, for cost or manufacturing reasons, the outside of the closure cap 40 may also be configured in a more conventional, flat-topped shape as shown in FIG. 4. The inner surface 60 of the annular skirt 46 includes threads 62 to complementarily engage the threads 24 formed on the container neck 22. Located above the threads 62, also integrally formed on the inner surface 60, is an annular liner securing bead 64 configured to retain the liner 30 within the closure cap 40 prior to assembly of the closure 10 to a container.

The fitment 70 (best seen in FIG. 2) is preferably stored in an inverted position (open side up) within the closure cap 40 above the liner 30. In FIG. 3, the fitment 70 can be seen separated from the liner 30 and the closure cap 40. The shape of the fitment 70 may be of any type generally suitable for dispensing the particular product in the container 20. As shown, the fitment 70 is a conventional sifter used with dispensers for powdered or granular substances such as spices and the like. The fitment 70 is preferably made of a flexible, self supporting plastic material such as polyethylene.

As depicted in FIGS. 2 and 3, the fitment 70, configured as a sifter, includes a top panel, or sifter dispensing surface 72 of a sufficient diameter to span the mouth 28 of the container 20 it is to be used on. The sifter dispensing surface 72 has formed therethrough at least one and preferably several sifter dispensing apertures 74. The apertures 74 are generally perpendicular in respect to the sifter dispensing surface 72, or they can be configured at various angles depending on the type and volume of the container contents to be dispensed. The sifter 70 includes an annular securing wall 76 depending from and integral with the dispensing surface 72. The sifter 70 further includes a fitment retaining bead 78 which is annular and projects radially from an inner surface 77 of the annular securing wall 76. As shown, the annular securing wall 76 is vertical, but it is contemplated that the securing wall can be angled inwardly to hold the fitment 70 more securely within the retaining area 48. The specific arrangement of the fitment 70 in the closure cap 40 can be varied while keeping with the principles disclosed herein. It is important aesthetically and for the proper assembly of the closure 10 that the lower edge 66 of the closure 40 does not contact the container 20 regardless of how the fitment 70 is placed within the closure 40.

An important feature of the closure 10 of the present invention is that the liner 30, closure cap 40 and sifter 70 can be economically manufactured separately and subsequently preassembled as a single unit for shipment to a location where it is applied to a container 20. Thus, an advantage of the present closure 10 is that the separate portions need not be stored, shipped and then assembled onto a container separately. Another significant feature of the present closure 10 is that the fitment 70 can be stored within the closure cap 40 in the fitment retaining area 48 to prevent it from separating from the closure 10. Following the placement of the fitment 70 within the area 48, the closure 10 can then be applied to a container 20 in one step by the bottler, saving both time and cost.

In FIG. 3, the fitment 70, shown detached and exploded from the container 20, may be stored within the retaining area 48 in an inverted position until the user removes it for application upon the container 20. It is contemplated that the securing bead 64 can support the liner 30 within the closure cap 40. Accordingly, the liner 30, which is supported by the securing bead 64, can aid in supporting the fitment 70 in retaining area 48 prior to assembly upon the container 20. Further, as depicted in FIG. 3, the surface of the container neck 22 may taper inwardly at a point 84, below the annular rim 26. The tapered surface 84 is configured to accept the fitment retaining bead 78 to provide an increased engagement of the fitment 70 onto the container mouth 28.

As depicted in FIG. 2, the inverted fitment 70 can be secured within the closure cap 40 since the fitment retaining bead 78 is configured to abut or squeeze against the inner channel wall 52. It should be understood that the fitment 70 can be retained within closure cap 40 without the use of a fitment retaining bead 78, wherein the annular securing wall 76 is dimensioned to tightly fit within the fitment retaining area 48, and more particularly, to abut against the inner channel wall 52. Further, as shown in FIG. 4, it is contemplated that the liner 30 can be retained within the closure cap 40 without a securing bead 64 by frictionally fitting the liner 30 against the inner surface 60 of the annular skirt 46. Thus, it should be understood that the closure cap 40 is configured to retain the fitment 70 within the closure 10 prior to assembly upon a container 20 and also after the user initially removes the closure cap 40.

In operation, the user will typically unscrew the closure cap 40, peel away the liner 30, remove the fitment 70 from the retaining area 48 of the closure cap 40 and snap the fitment onto the container mouth 28. Since the fitment 70 is not secured to the container at the time of assembly, the user is not burdened with having to remove the fitment from the container in order to peel away the liner and then reapply the fitment to dispense the contents of the container.

In another embodiment of the present closure, depicted in FIG. 4, the assembled closure cap and fitment is generally designated 100. As in the preferred embodiment, this embodiment includes a protective liner 130, a closure cap 140 and a fitment 170 that can be preassembled for storage, shipment or assembly onto a container 120 as a unit. Unlike the closure 10, the outside of the closure cap 140 has a flattened top panel 142. The closure cap 140 also includes a peripheral edge 144 and a depending annular skirt 146 integral with edge 144. Noticeably absent from this embodiment is the various outer visible portions which are the result of the formations defining the fitment retaining area 48 as shown in FIGS. 1–3.

In closure 100, the fitment is retained within a fitment retaining area 148 in an inverted position. An annular ring 150 is integrally formed on an upper surface 152 of the closure cap 140 and defines the inner boundary of the fitment retaining area 148. The fitment 170 has an annular wall 176 integral with and depending from the dispensing surface 172. The fitment 170 has an inner surface 177 having a tapered or angled configuration. The inner surface 177 abuts or squeezes against the outside periphery 154 of the ring 150 to retain the fitment 170 in its inverted position within the closure cap 140 until removal by the user.

The ring 150 is formed so that its lower edge 156 is aligned vertically with the lip 126 of the container mouth 128. The alignment between the lip 126 and mouth 128 aids in heat induction during application of the closure 100 to the container 120. Secondarily, the ring 150 provides a support backing for the fitment 170 to prevent deformation of the fitment 170 upon application of the closure 100 to the container 120. Further, it is contemplated that a plurality of retaining fins 158 can be integrally formed on the inner surface 160 of the closure cap 140. The fins 158 provide further support to the fitment 170, as well as, maintaining the fitment 170 centrally within the closure cap 140 to facilitate assembly of the closure 100 and its application to the container 120. The specific number and arrangement of the fins 158 can be varied while keeping within the principles disclosed herein.

A friction fit between the liner 130 and the inner wall 160 is utilized to retain the liner 130 within the closure cap 140 prior to assembly upon the container 120 if a retaining bead, such as bead 64 of closure 10, is not desired. A pull tab 134 may be integrated with the liner 130 to facilitate removal of the liner 130 when the user desires to access the contents of the container 120. In use, the fitment 170 can be dislodged from within the closure cap 140, the liner 130 peeled from the container mouth 128 and the fitment placed onto the mouth 128. It is contemplated that to facilitate removal of the fitment 170, an inner surface 132 of the liner 130 will be lightly adhered to the fitment 170 with minute amounts of a non-toxic adhesive. It should be appreciated that the adhesion may also be effected through the use of a fitment 170 made of a plastic material that has a natural affinity to the material of the liner 130 upon the application of heat or pressure.

Figure 4A:
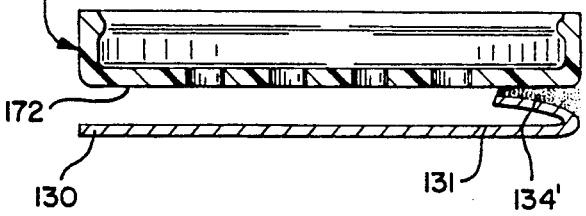
FIG. 4 is a vertical sectional view of an alternate embodiment of the present closure and fitment assembly shown in FIG. 2.
Figure 4:
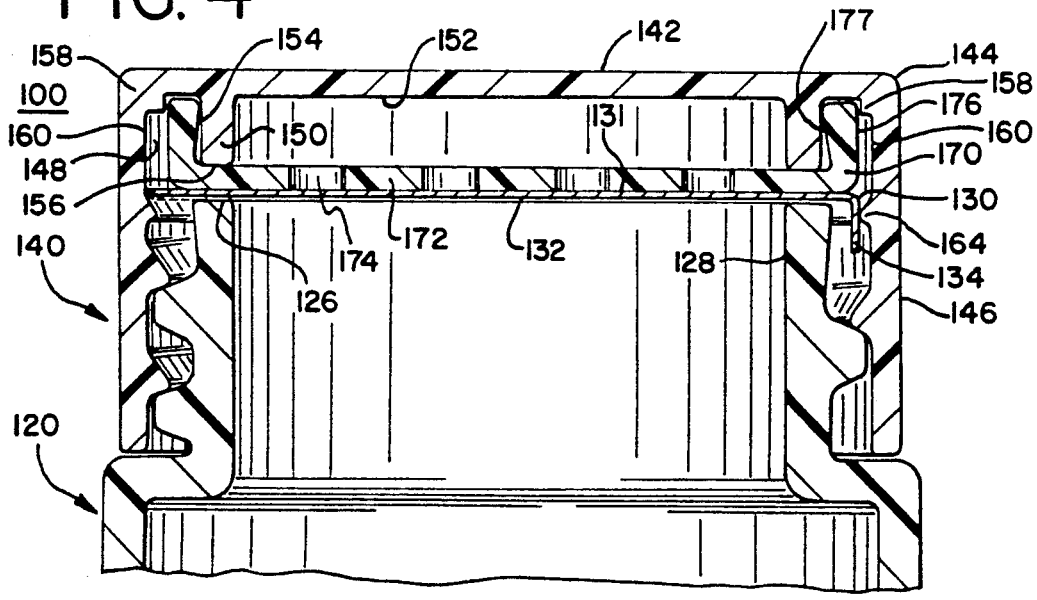

Depicted in FIG. 4A is yet another optional feature of the present invention, wherein the fitment 170 can be secured to a portion of the liner 130. In accordance with the other embodiments and the overall objective of the invention, once the unit 100 is assembled, the fitment 170, liner 130, and closure cap 140 can be stored, shipped and applied to a container 120 as a unit. As in the various other embodiments of FIGS. 1–4, it is preferable that the fitment 170 is stored within the closure cap 140 in an inverted position below the top panel 142 above the liner 130. However, particular uses may dictate storage of the fitment 170 in an upright position. The fitment 170 can be retained in an inverted position within the closure cap 140 using an annular ring 150 such as is shown in FIG. 4. Alternatively, as in FIG. 4, the fitment 170 may be held in place by using the liner 130 in conjunction with a liner retaining bead 164 to support the fitment 170 up and within the closure cap 140. It will be appreciated that a friction fit between the periphery of the liner 130 and an inner surface 160 of the closure cap 140 may be utilized to retain the fitment 170 therein.

Regardless of the manner used to retain the fitment 170 and liner 130 within the closure cap 140, the fitment 170 can be adhesively or otherwise removably secured to a portion of the liner 130, such as onto tab 134' of FIG. 4A using methods of heat induction, conduction, adhesive or other available techniques generally used in the industry. The tab 134' is folded or bent over onto an upper surface 131 of the liner 130 so that the tab 134' may be secured to the dispensing surface 172 of the fitment 170.

Once the closure assembly 100 has been assembled onto a container 120, such as by heat induction or other similar techniques, the fitment 170, having been previously secured to the tab 134' of the liner 130, will remain with the liner 130 upon removal of the closure cap 140 by the user. Hence, the fitment 170 remains secured to the liner 130 and is separated from the closure cap 140 when the user initially removes the closure cap 140. After removing the closure cap 140 to expose the fitment 170, which is still secured to the liner 130 at the tab 134', the user can grasp the fitment 170 and use it as an extension of the tab 134' to peel off the liner 130. Once the liner 130 has been peeled off of the container mouth 128, the user can detach the fitment from the liner 130 and apply the fitment 170 to mouth 128 to regulate the dispensing of the contents of the container 120.

An important advantage of the optional feature of FIG. 4A is that the fitment 170 will remain removably attached to the container via the liner 130, particularly the tab 134', instead of falling to the floor when the user first opens the container 120. Further, because the fitment 170 is secured to the liner 130, the fitment 170 will also facilitate the removal of the liner 130 from the container mouth 128 upon initial use of the container 120 by the user. Finally, because the fitment 170 is attached to the pull tab 134' of the liner 130, it will remain steady and centered within the closure cap during storage, transportation and application.

Overall, the configuration and structural inner-relationship of the closure, fitment and liner of the present invention eliminate many of the costly and time consuming problems associated with shipping, handling and assembling the closure, fitment and liner separately. Moreover, the closure, fitment and liner assembled as a unit can be engaged upon a container in one step during the container manufacturing and/or filling process.

While a preferred and an alternative embodiment of the invention have been shown and described, it should be understood that there is no intent to limit the invention by such disclosure, but rather it is intended to cover all modifications and alternative constructions that fall within the spirit and the scope of the invention as defined in the appended claims.

What is claimed:

1. A closure cap and fitment assembly configured for use with a container for holding a desired contents and having a neck with an annular lip at an uppermost end of the neck defining a mouth, said closure cap and fitment assembly comprising:

a fitment having a dispensing surface dimensioned to span the mouth of the container; and a cap having a top panel, an annular skirt depending peripherally from said top panel and means for releasable engagement onto the neck of the container, said cap defining fitment retaining means for retaining said fitment within said cap; and said fitment retaining means being adapted to store said fitment within said cap in an inverted orientation.

2. The assembly as described in claim 1, wherein said fitment has an annular securing wall depending peripherally from said dispensing surface.

3. The assembly as described in claim 2, wherein said annular securing wall includes an annular retaining bead disposed on an inner surface of said wall.

4. The assembly as described in claim 1, wherein said fitment retaining means comprises an annular inner chamber configured to store said fitment within said cap.

5. The assembly as described in claim 4, wherein said annular inner chamber includes an annular channel defined by an outer channel wall and an inner channel wall formed within said annular inner chamber.

6. The assembly as described in claim 4, wherein said annular inner chamber includes at least one wall and said fitment further includes an annular retaining bead which releasably, frictionally engages said at least one wall when said fitment is stored in said chamber.

7. The assembly as described in claim 4 wherein said annular inner chamber further includes at least one retaining fin formed on an inner peripheral wall of said annular inner chamber, said retaining fin configured to center said fitment within said annular inner chamber of said cap.

8. The assembly as described in claim 1, wherein said skirt has an inner surface provided with an annular securing bead for retaining a liner.

9. The assembly as described in claim 8, further including a liner disposed in said cap between said bead and said fitment to retain said fitment within said cap, said liner including adhesive means for sealing said liner to the lip of the container to cover the mouth of the container and thereby prevent tampering, leakage or spoilage of the contents of the container prior to application of the fitment onto the container mouth.

10. A closure cap and fitment assembly configured for releasable engagement on a container as a unit, the container for holding a desired contents and having a neck with an annular lip at an uppermost end of the neck defining a mouth, and threads formed below the mouth, said closure cap and fitment assembly comprising:

a fitment having a dispensing surface configured to span the mouth of the container;

a cap having a top panel, an annular inner chamber and an annular skirt depending peripherally from said top panel, said skirt having an inside surface provided with threads for releasable engagement with the neck of the container;

said annular inner chamber of said cap being configured and arranged to receive and retain said fitment a liner having an upper surface and a lower surface, said liner including adhesive means on said lower surface for sealing said liner to the annular lip of the container; and said fitment being removably secured to a portion of said upper surface of said liner.

11. The assembly as described in claim 10, wherein said fitment has an annular securing wall with an annular retaining bead formed on an inside surface of said securing wall.

12. The assembly as described in claim 10, wherein said annular inner chamber includes fitment retaining means for storing said fitment in an inverted orientation within said cap.

13. The assembly as described in claim 10, wherein said annular inner chamber of said cap is configured as an annular channel.

14. The assembly as described in claim 13, wherein said annular inner chamber includes at least one wall, and said fitment further includes an annular retaining bead which releasably, frictionally engages said at least one wall when said fitment is stored within said chamber.

15. The assembly as described in claim 10 wherein said liner includes a tab integrally formed thereto to facilitate removal of said liner from the mouth of the container.

16. The assembly as described in claim 10, wherein said fitment is removably secured by adhering means to a portion of said upper surface of said liner.

17. A closure cap, sifter fitment and liner assembly configured as a unit for assembly on a container, the container for storing a desired contents and having a neck with an annular lip at an uppermost end defining a mouth, the container further having threads formed integrally on the neck below the mouth, said assembly comprising:

a fitment having a dispensing surface dimensioned to span the mouth of the container, said fitment having a plurality of apertures for dispensing the contents of the container;

a cap having a top panel, an annular skirt depending peripherally from said top panel, a peripheral edge and an upper inner surface, said cap including an annular inner chamber having an annular ring integrally formed on said upper inner surface for releasably retaining said fitment within said annular inner chamber;

a liner having an upper surface and a lower surface, said lower surface having adhesive means for sealing said liner to the annular lip of the container, said liner includes a tab integrally formed thereon; and said tap being located between said upper surface of said liner and said dispensing surface of said fitment, said tab being removably secured to said dispensing surface of said fitment.

18. The assembly as described in claim 17 wherein said liner is dimensioned to engage an inner surface of said annular skirt to frictionally and releasably retain said liner within said cap, said liner providing support for said fitment within said cap.

19. The assembly as described in claim 17, wherein said annular inner chamber includes means for storing said fitment in an inverted orientation within said cap.

20. The assembly as described in claim 17, wherein said annular inner chamber includes at least one retaining fin located on an inner peripheral wall of said annular inner chamber, said retaining fin configured to center and increase the retainment of said fitment within said annular inner chamber of said cap.

* * * * *